US005698355A

United States Patent [19]

Imai et al.

[11] Patent Number: 5,698,355

[45] Date of Patent: Dec. 16, 1997

[54] PHOTOSENSITIVE BODY FOR ELECTROPHOTOGRAPHY

[75] Inventors: Akira Imai; Takeshi Agata; Yasuo Yamamoto; Yutaka Sugizaki; Katsuhiro Sato, all of Minami-Ashigara, Japan

[73] Assignee: Fuji Xerox Co., Ltd., Tokyo, Japan

[21] Appl. No.: 767,301

[22] Filed: Dec. 16, 1996

[30] Foreign Application Priority Data

Dec. 21, 1995 [JP] Japan ..... 7-333374

[51] Int. Cl.[6] ..... G03G 5/14

[52] U.S. Cl. ..... 430/60; 430/61; 430/62

[58] Field of Search ..... 430/60, 61, 62

[56] References Cited

U.S. PATENT DOCUMENTS 5,238,763 8/1993 Sullivan et al. ..... 430/60

FOREIGN PATENT DOCUMENTS 48-47344 7/1973 Japan .
52-20386 2/1977 Japan .
55-142356 11/1980 Japan .
56-32146 4/1981 Japan .
58-30757 2/1983 Japan .
59-170846 9/1984 Japan .
60-225856 11/1985 Japan .
2-123370 5/1990 Japan .
4-353856 12/1992 Japan .

*Primary Examiner*—Roland Martin
*Attorney, Agent, or Firm*—Oliff & Berridge

[57] ABSTRACT

A photosensitive body for electrophotography having improved properties in the charging characteristics, photosensitivity, and stability in repeated use. The photosensitive body for electrophotography comprises a photoconductive layer formed on a conductive support through an undercoat layer, the undercoat layer containing at least one polyester compound having repeated units represented by the following general formula (I):

$$\left(\underset{\underset{O}{\|}}{C}-A-\underset{\underset{O}{\|}}{C}-O-B-O\right)_n \qquad (I)$$

wherein A and B each independently represents a divalent aliphatic hydrocarbon or aromatic hydrocarbon which is optionally substituted, at least one of A and B being selected from the group consisting of specific divalent groups, and n is 10–10,000.

20 Claims, No Drawings

PHOTOSENSITIVE BODY FOR ELECTROPHOTOGRAPHY

BACKGROUND OF THE INVENTION

1. Field of the Invention

The present invention relates to a photosensitive body for electrophotography in which a particular polymer compound is used as a component of an undercoat layer.

2. Description of Related Art

There have been problems that when a photoconductive layer is formed directly on a conductive support in photosensitive bodies for electrophotography used for copying machines, printers, and facsimile machines employing electrophotographic techniques, charging characteristics are not good and electric potential is not stable after repeated use.

In addition, the photoconductive layer may be separated from the conductive support due to poor adhesion between the photoconductive layer and the conductive support. Furthermore, there may be the formation of an application defect when the photoconductive layer is applied to the conductive support.

Non-uniformity of the thickness of the photoconductive layer may be caused which is attributable to irregularities in the surface of the conductive support. This results in a defect in images, such as black spots and voids.

Attempts have been made to provide an undercoat layer between the conductive support and the photoconductive layer as an approach to solve the above-mentioned problems. Fundamental features required for the undercoat layer are: (1) capable of preventing charge injection from the conductive support while the photosensitive body is not exposed to light; (2) capable of releasing the electric charges in the photosensitive body to the conductive support while it is exposed to light; (3) accumulating no electric charge and not changing in electrical properties during continuous use; (4) reducing influence of irregularities in the surface of the conductive support; and (5) having adhesion to the conductive support and having uniform and strong adhesion to a charge generating layer formed on the undercoat layer. As raw materials for the above-mentioned undercoat layer, it has been considered to use thermoplastic resins such as polyvinyl acetate, polyvinyl alcohol, polyvinyl formal, polyvinyl butyral, polyester, and polyamide, or thermosetting resins such as epoxy resins, melamine resins, urethane resins, and phenol resins as disclosed in, for example, Japanese Patent Application Laid-Open (JP-A) Nos. 48-47344, 52-20386, 58-30757, and 60-225856.

There is, however, a problem that the undercoat layer based on these resin materials tends to cause reduction in photosensitivity and increase in residual electric potential of the photosensitive body when the thickness of the undercoat layer is increased in order to significantly improve the above-mentioned charging characteristics and overcome the image defects.

In addition, concerning most of the undercoat layers using such a resin material transfer of the electric charge in the resin layer is dependent mainly on ion conduction, so that it is more likely affected by the change of humidity in the air. In particular, a low temperature and low humidity environment markedly reduces and photosensitivity and increases the residual electric potential.

To avoid these problems, it has been considered to use an undercoat layer obtained by means of adding a low molecule charge transport substance or electron acceptor substance to a polymer resin as disclosed in JP-A Nos. 55-142356 and 59-170846.

These low molecule compounds are exuded into an upper layer to decrease the concentration thereof in the undercoat layer in the process of applying a photoconductive layer on the undercoat layer formed on a conductive support when having a good solubility to an organic solvent. On the contrary, the low molecule compounds tend to be crystallized in the undercoat layer when they are slightly soluble to the organic solvent. Accordingly, there is a problem that a desired improvement can hardly be achieved.

SUMMARY OF THE INVENTION

An object of the present invention is to achieve the above-mentioned problems and to provide a photosensitive body for electrophotography having improved properties in the charging characteristics, photosensitivity, and stability in repeated service.

The object of the present invention can be achieved by means of using an undercoat layer containing a polyester compound represented by the following general formula (I).

More specifically, a photosensitive body for electrophotography according to the present invention comprises a photoconductive layer formed on a conductive support through an undercoat layer, the undercoat layer containing at least one polyester compound having repeated units represented by the following general formula (I):

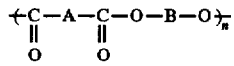

(I)

wherein A and B each independently represents a divalent aliphatic hydrocarbon or aromatic hydrocarbon which is optionally substituted, at least one of A and B being selected from the group consisting of divalent groups represented by the following general formulae (II)–(VI), and n is 10–10,000. Preferably, n is 50–1,000:

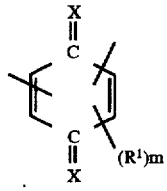

(II)

wherein $R^1$ represents an alkyl group, an aryl group, a halogen atom, a nitro group, an acyl group, or an amino group, X represents an oxygen atom or a group represented by the formula II-1),

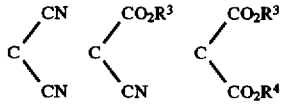

(II-1)

wherein $R^3$ and $R^4$ each independently represents an alkyl group or an aryl group, and m represents an integer of 0–2:

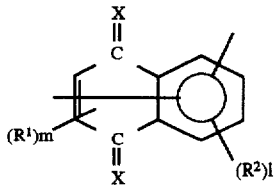

(III)

wherein, $R^1$, $R^3$, $R^4$, X and m are same as those defined above, $R^2$ is selected independently of $R^1$ and represents an alkyl group, an aryl group, a halogen atom, a nitro atom, an acyl group, or an amino group, and 1 is selected independently of m and represents an integer of 0–2, (IV)

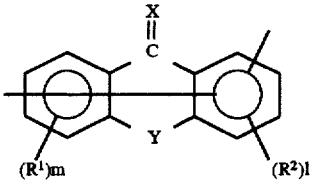

wherein $R^1$, $R_2$, X, m, and l are same as those represented by the aforementioned general formula (III), Y represents C=X (X is same as the one defined above), O, S, $SO_2$, or $NR^5$, $R^5$ represents a hydrogen atom, an alkyl group, an aryl group, or an acyl group, (V)

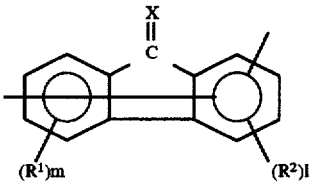

wherein $R^1$, $R^2$, X, m, and l are same as those represented by the aforementioned general formula (III), and (VI)

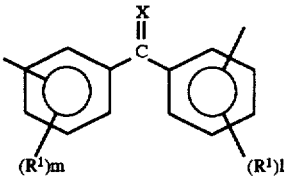

wherein $R^1$, $R^2$, X, m, and l are same as those represented by the aforementioned general formula (III).

A weight-average molecular weight of the above-mentioned polyester is typically from 2,000 to 1,000,000, and preferably from 20,000 to 500,000.

The photosensitive body for electrophotography according to the present invention has good charging characteristics, is highly sensitive even at a low temperature and low humidity, has a low residual electric potential, and is capable of exhibiting constantly stable properties after the many-time use.

An organic low molecule compound is dispersed in the undercoat layer according to one aspect of the present invention.

DESCRIPTION OF PREFERRED EMBODIMENTS OF THE INVENTION

Preferred embodiments of the present invention will be described below.

A photosensitive body for electrophotography according to the present invention comprises a photoconductive layer formed on a conductive support through an undercoat layer, the undercoat layer preferably containing at least one polyester compound having repeated units represented by the following general formula (I'):

$$\left(\underset{\underset{O}{\|}}{C}-A'-\underset{\underset{O}{\|}}{C}-O-B'-O\right)_{n'} \quad (I')$$

wherein A' and B' each independently represents a divalent aliphatic hydrocarbon or aromatic hydrocarbon which is optionally substituted, at least one of A' and B' being selected from the group consisting of divalent groups represented by the following general formulae (II')–(VI'), and n is 10–10,000:

(II')

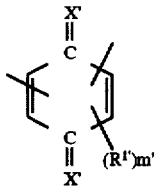

wherein $R^{1'}$ represents an alkyl group having from 1 to 4 carbon atoms, an aryl group having from 6 to 10 carbon atoms, a halogen atom, a nitro group, an acyl group, or an amino group, X' represents an oxygen atom or a group represented by the formula (II-1'),

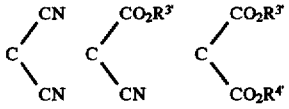

wherein $R^{3'}$ and $R^{4'}$ each independently represents an alkyl group having from 1 to 4 carbon atoms or an aryl group having from 6 to 10 carbon atoms, and m' represents an integer of 0–2, (III')

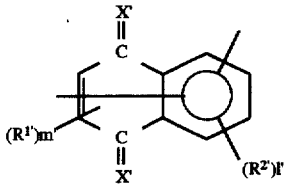

wherein, $R^{1'}$, $R^{3'}$, $R^{4'}$, X' and m' are same as those defined above, $R^{2'}$ is independent of $R^{1'}$ and represents an alkyl group having from 1 to 4 carbon atoms, an aryl group having from 6 to 10 carbon atoms, a halogen atom, a nitro atom, an acyl group, or an amino group, and l' represents, independently of m', an integer of 0–2, (IV')

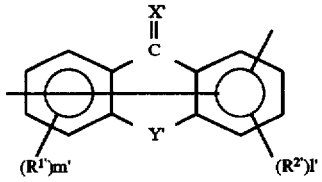

wherein $R^{1'}$, $R^{2'}$, X', m' and 1' are same as those represented by the aforementioned general formula (III'), Y' represents C=X' (X' is same as the one defined above), O, S, $SO_2$, or $NR^{5'}$, $R^{5'}$ represents a hydrogen atom, an alkyl group having from 1 to 10 carbon atoms, an aryl group having from 6 to 10 carbon atoms, or an acyl group, (V')

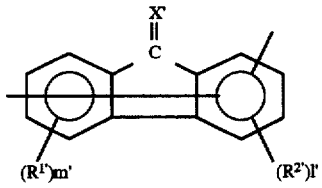

wherein $R^{1'}$, $R^{2'}$, X', m', and l' are same as those represented by the aforementioned general formula (III'), and

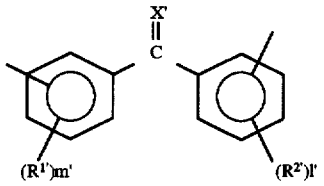

(VI')

wherein $R^{1'}$, $R^{2'}$, X', m', and l' are same as those represented by the aforementioned general formula (III').

The polyester compound represented by the aforementioned general formula (I) used in the present invention may be synthesized by means of reacting an aliphatic or aromatic dicarboxylic chloride represented by the following general formula (VII) with an aliphatic or aromatic diol represented by the following general formula (VIII) in the presence of a support, or by means of reacting an aliphatic or aromatic dicarboxylic acid ester represented by the following general formula (VII) with an aliphatic or aromatic diol represented by the general formula (IX):

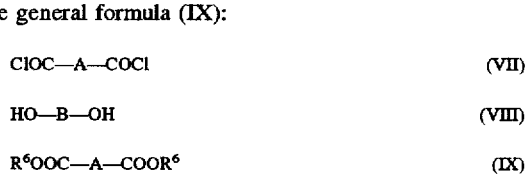

ClOC—A—COCl (VII)

HO—B—OH (VIII)

$R^6OOC—A—COOR^6$ (IX)

wherein A and B represent a divalent aliphatic hydrocarbon or aromatic hydrocarbon which is optionally substituted, and at least one of A and B represent a divalent group represented by the aforementioned general formulae (II)–(IV). $R^6$ represents an alkyl group or a phenyl group.

Specific examples of the polyester compound represented by the aforementioned general formula (I) are illustrated below. However, the present invention is not limited to those using the exemplified compounds.

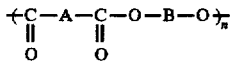

| Compound No. | A | B |
|---|---|---|
| 1 | 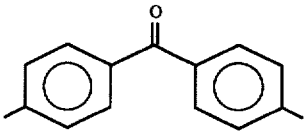 | $-(CH_2)_{10}-$ |
| 2 | 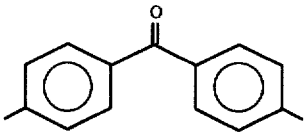 | 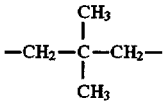 |
| 3 | 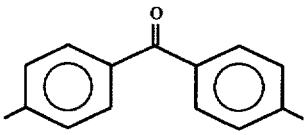 | 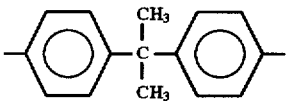 |
| 4 | 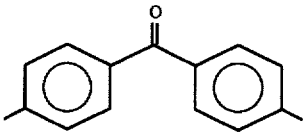 | 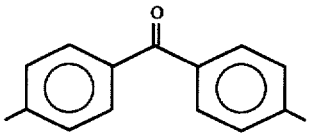 |
| 5 | 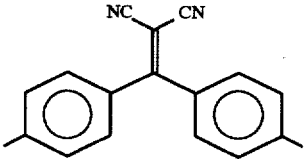 | $-(CH_2)_{12}-$ |
| 6 | 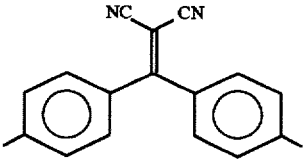 | 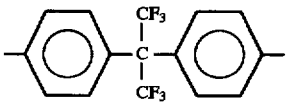 |

-continued
$$\left[\underset{\underset{O}{\|}}{C}-A-\underset{\underset{O}{\|}}{C}-O-B-O\right]_n$$
| Compound No. | A | B |
|---|---|---|
| 7 | $-(CH_2)_6-$ | 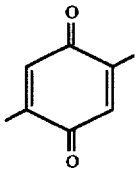 |
| 8 | 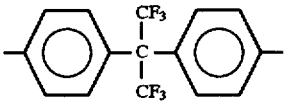 | 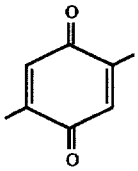 |
| 9 | 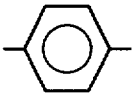 | 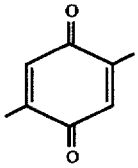 |
| 10 | $-(CH_2)_{12}-$ | 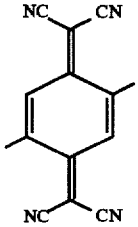 |
| 11 | $-(CH_2)_8-$ | 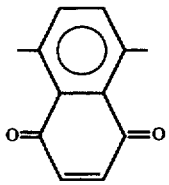 |
| 12 | 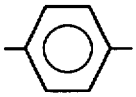 | 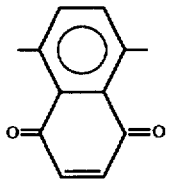 |
| 13 | 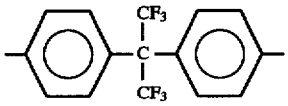 | 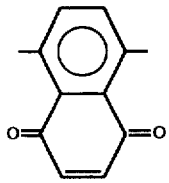 |
| 14 | $-(CH_2)_6-$ | 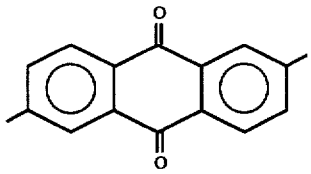 |

-continued
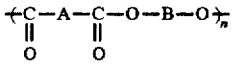
| Compound No. | A | B |
|---|---|---|
| 15 | $-(CH_2)_{10}-$ | 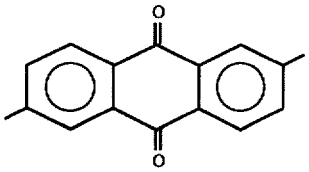 |
| 16 | 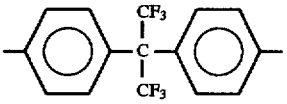 | 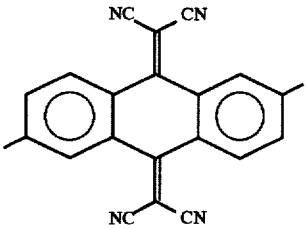 |
| 17 | $-(CH_2)_7-$ | 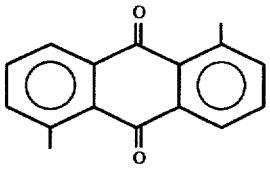 |
| 18 | $-(CH_2)_{10}-$ | 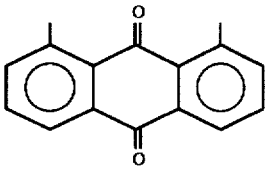 |
| 19 | $-(CH_2)_6-$ | 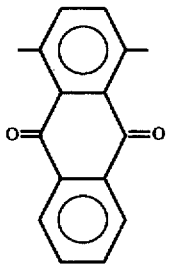 |
| 20 | $-(CH_2)_8-$ | 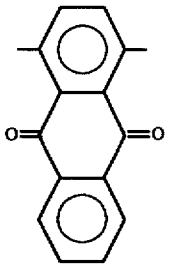 |

-continued
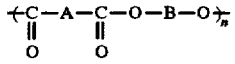
| Compound No. | A | B |
|---|---|---|
| 21 | 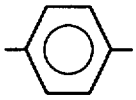 | 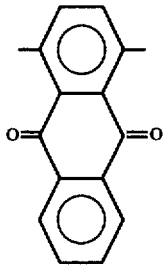 |
| 22 | 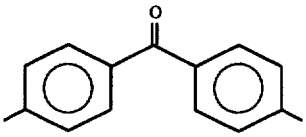 | 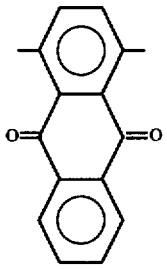 |
| 23 | 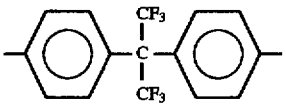 | 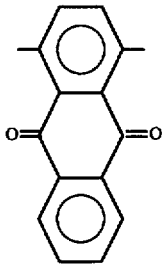 |
| 24 | $-(CH_2)_6-$ | 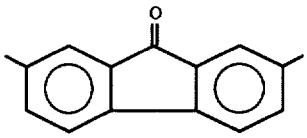 |
| 25 | $-(CH_2)_7-$ | 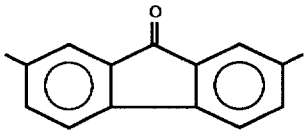 |
| 26 | 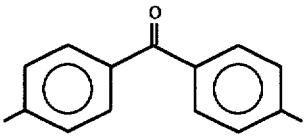 | 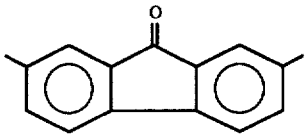 |
| 27 | 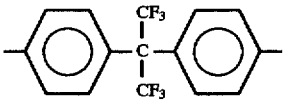 | 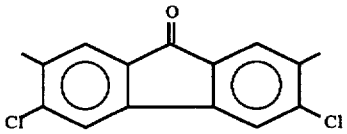 |
| 28 | $-(CH_2)_8-$ | 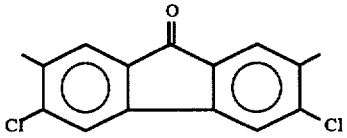 |

-continued $$\left[\underset{\underset{O}{\|}}{C}-A-\underset{\underset{O}{\|}}{C}-O-B-O\right]_n$$

| Compound No. | A | B |
|---|---|---|
| 29 | $-(CH_2)_7-$ | 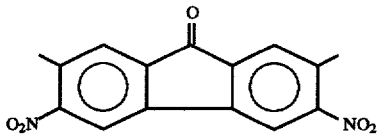 |
| 30 | 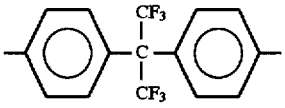 | 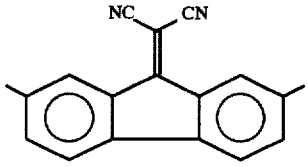 |
| 31 | $-(CH_2)_6-$ | 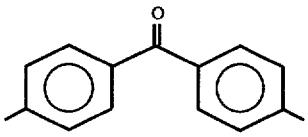 |
| 32 | $-(CH_2)_8-$ | 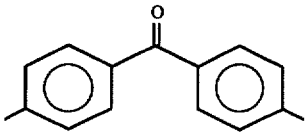 |
| 33 | 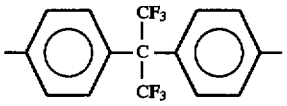 | 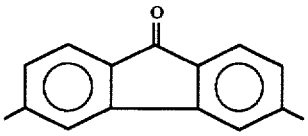 |
| 34 | $-(CH_2)_7-$ | 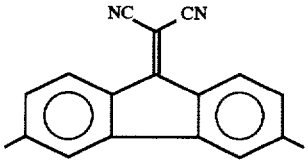 |
| 35 | 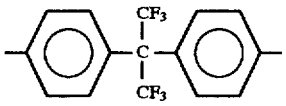 | 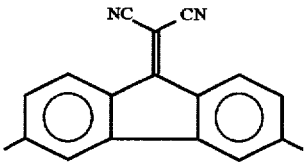 |
| 36 | $-(CH_2)_7-$ | 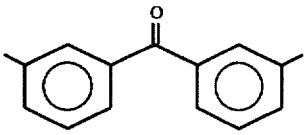 |

In the photosensitive body for electrophotography according to the present invention, the above-mentioned object can be achieved by means of containing the polyester compound represented by the aforementioned general formula (I) as a component of the undercoat layer.

More specifically, the polyester compound represented by the aforementioned general formula (I) used in the present invention is a polymer resin material having an electron transfer property, and use of this compound as the component of the undercoat layer makes it possible to inhibit any injection of positive charges from the photoconductive layer to the conductive support and selectively transfer only negative charges, thereby realizing good electrification, high photosensitivity, and low residual electric potential without being affected by the change of humidity in the air.

The component of the undercoat layer may be a single or a mixture of polyester compound(s) represented by the aforementioned general formula (I). Alternatively, the component of the undercoat layer may be used as a blend with other typical polymer material or materials suitable for the undercoat layer as long as the advantageous effect of the present invention is not reduced.

Examples of the polymer material that may be blended include thermoplastic resins such as polyacrylate derivatives, polyvinyl acetate, polyvinyl alcohol, polyvinyl formal, polyvinyl butyral, polyester, polycarbonate, and polyamide, and thermosetting resins such as epoxy resins, melamine resins, and urethane resins. When such polymer material is used together, it is preferable that the polyester compound represented by the aforementioned general formula (I) according to the present invention is 60% or more by weight of the polymer materials making up the undercoat layer.

The polyester compound according to the present invention may be a copolymer polyester having other repeated units. Examples of the copolymer polyester having other repeated units include a combination of two or more polyester compounds represented by the aforementioned general formula (I) or a combination of the polyester compound represented by the aforementioned general formula (I) with other common polyester compound. Examples of the common polyester compound available for the above purpose include aliphatic polyesters such as polyethylene adipate and polyhexamethylene sebacate, and aromatic polyesters such as polyethylene terephthalate and poly(p-phenylene)adipate.

These copolymer polyesters may be synthesized by using two or more kinds of at least one component of the dicarbonyl chloride represented by the aforementioned general formula (VII), the diols represented by the aforementioned general formula (VIII), and the dicarboxylic acid ester represented by the aforementioned general formula (IX); or a dicarbonyl chloride, diols, or dicarboxylic acid esters that are monomer components of other common polyester compounds, which are mixed or added successively for the reaction.

In the photosensitive body for electrophotography according to the present invention, a specific organic low molecule compound may be contained along with the polyester compound represented by the aforementioned general formula (I) in the undercoat layer for the purpose of improving electric properties. Preferred examples of the organic low molecule compound available in such a case include an low molecule electron acceptor compound, electron donor compound, or metal complex salt, and other compounds that have a function to enhance or control electron conductivity by independent action of the above-mentioned polyester compound or interaction with the above-mentioned polyester compound, for example, so as to form a charge transfer complex.

Examples of the electron acceptor compound include aromatic nitro compounds such as 4-nitrobenzaldehyde, cyclic carboxylic acid anhydride such as maleic anhydride, aromatic carboxylic imide such as N-(n-butyl)-1,8-naphthalimide, quitone such as p-chloranil and 2,3-dichloroanthraquinone, tetracyanoxydimethane derivatives such as tetracyanoanthraquinonedimethane, and fluorenone derivanives such as 9-dicyanomethylenefluorene-4-n-octyl carboxylate.

Examples of the electron donor compound include oxadiazoles such as (2,5-bis(4-dimethylaminophenyl)-1,3,4-oxadiazole, styryl-based compounds such as 9-(4-diethylaminostyryl)anthracene, carbazole compounds such as N-methyl-N-phenylhydrazone-3-methylidene-9-ethylcarbazole, pyrazoline-based compounds such as 1-phenyl-3-(p-dimethylaminostyryl)-5-(p-dimethylaminophenyl)-pyrazoline, triphenyl amine-based compounds such as N,N'-diphenyl-N,N'-bis(3-methylphenyl)benzidine, tri(4-methylphenyl)amine, and N,N-bis(3,4-dimethylphenyl)biphenyl-4-amine, tetrathiafluvalene, and N,N,N',N'-tetraethylphenylenediamine.

Examples of the organic metal complex salt include various chelate complexes such as acetyl acetone complexes of, for example, transition metal elements or Group III and IV metal elements, acetoacetic acid ester complexes, oxyquinoline complexes, and phenanthroline complexes, and cyclopentadienyl complexes such as ferrocene.

The above-mentioned organic low molecule compounds may be used alone or as a combination of two or more of them. The amount thereof added may be determined arbitrarily in the range of 1–30% by weight relative to the total amount of the resin component used for the undercoat layer.

The undercoat layer may be subjected to various curing treatments in order to improve its mechanical strength, bond strength to the conductive support, or anti-solubility to the solvent used when the photoconductive layer is applied and formed. The curing treatment may be carried out by means of mixing the polyester compound represented by the aforementioned general formula (I) with a thermosetting resin such as an epoxy resin, a phenol resin, and a melamine resin or an adequate coupling agent such as a silane coupling agent, a zirconium coupling agent, and a titanate coupling agent, which is applied to the conductive support and reacted for curing by means of, for example, heating, exposure to light, or adequate chemical treatment.

The undercoat layer may be formed by means of dissolving the above-mentioned polyester compound and the above-mentioned polymer material mixed if desired, in an organic solvent; applying it to the conductive support by, for example, dipping; and heating and drying the resultant.

The organic solvent used for this purpose may be adequately selected from alcohol-based solvents such as 2-propanol and 1-butanol, ketone-based solvents such as methyl ethyl ketone and cyclohexane, halogen-based solvents such as dichloromethane, and 1,1,2,2-tetrachloroethane, aromatic solvents such as chlorobenzene, and m-cresol, and amide-based solvents such as N,N-dimethylacetoamide, and N-methylpyrrolidone. Of these, halogen-based and amide-based solvents are advantageously used. Drying after the application is carried out at a temperature ranging from 50° to 200° C.

To disperse the above-mentioned organic low molecule solvent into the undercoat layer, the polymer material containing the polyester compound making up the undercoat layer is dissolved into an organic solvent, to which the organic low molecule compound is added and mixed therewith. The resultant coating solution is applied to the conductive support by means of, for example, dipping; heated, and dried to produce the undercoat layer.

The applicable organic solvents are similar to those exemplified in terms of the formation of the above-mentioned undercoat layer.

The thickness of the undercoat layer may be determined arbitrary in a range of 0.1–10 μm, preferably in a range of 0.1–5.0 μm.

The photoconductive layer constituting the photosensitive body for electrophotography according to the present invention may be either a single-layered type formed of a single layer containing a charge generating substance and a charge transfer substance, or a laminated type formed of two layers, i.e., a layer containing a charge generating substance and a layer containing a charge transfer substance. A remarkable improvement by the present invention can be obtained when the photoconductive layer is the laminated type. A surface layer may be laminated on the photoconductive layer, if necessary.

For the photosensitive body for electrophotography of the laminated type, the charge generating layer may be formed by means of (1) i)dispersing a charge generating substance into an organic solvent along with an adequate binding resin, ii) applying it to an undercoat layer by, for example, dipping, and iii) drying the coated layer, or (2) deposition.

The charge generating substance used for the charge generating layer may be phthalocyanine pigments, azo pigments, perylene pigments, and fused ring aromatic pigments such as dibromoanthanthrone, or squarylium pigments. A remarkable improvement by the present invention can be obtained particularly when using the phthalocyanine pigments such as metal-free phthalocyanine, chloro gallium phthalocyanine, hydroxy gallium phthalocyanine, dichloro tin phthalocyanine, or titanyl phthalocyanine.

The binding resin may be selected from polyvinyl formal, polyvinyl butyral, polyvinyl alcohol, polyester, polycarbonate, and polymethyl methacrylate.

The thickness of the charge generating layer may be determined arbitrarily in a range of from 0.1 to 5 μm, and preferably in a range of from 0.1 to 0.5 μm.

In the photosensitive body for electrophotography of the laminated type, the charge transfer layer may be formed by means of dissolving a charge transfer substance into an organic solvent along with an adequate binding resin; applying it to the above-mentioned charge generating layer by, for example, dipping; and drying it.

The charge transfer substance used may be selected from, for example, polycyclic aromatic compounds such as anthracene, and pyrene, nitrogen-containing heterocyclic compound such as carbazole, and imidazole, hydrazone derivatives, stilbene derivatives, triphenylamine derivatives, and tetraphenyl benzidine derivatives.

The binding resin may be selected from, for example, polyester, polycarbonate, and polymethyl methacrylate.

The thickness of the charge transfer layer may be selected in a range of from 5 to 40 μm, and preferably in a range of from 5 to 30 μm.

EXAMPLES

The present invention will be described specifically in conjunction with examples of synthesis and other set of examples. However, the present invention is not limited to the following examples.

SYNTHESIS OF POLYESTER COMPOUND

Example of Synthesis 1 (Synthesis of [Compound (1)])

1.74 g (10 mmol) of 1,10-decanediol and 2.0 ml (25 mmol) of pyridine were dissolved into 30 ml of 1,1,2,2-tetrachloroethane, to which a solution obtained by dissolving 3.07 g (10 mmol) of benzophenone-4,4'-dicarbonyl chloride into 30 ml of 1,1,2,2-tetrachloroethane was added dropwise while being heated to approximately 50° C. and stirred for about 1 hour. After the dropping, the mixture was stirred for additional four hours and was poured into 300 ml of methanol to separate a precipitation. The precipitation was filtered, washed with methanol, water, and acetone, and dried under a reduced pressure to obtain 3.14 g of white solid (yields: 77%).

An infrared absorption spectrum of the resultant white solid was measured.

Infrared Absorption Spectrum: 726, 1666, 1266 $cm^{-1}$

Example of Synthesis 2 (Synthesis of [Compound (7)])

1.40 g (10 mmol) of 2,5-dihydroxy-1,4-benzoquinone and 0.82 g (20 mmol) of sodium hydroxide were dissolved into 30 ml of water, to which 50 mg of tetra(n-butyl)ammonium iodide was added. Then, a solution obtained by dissolving 1.80 ml (10 mmol) of suberyloyl chloride into 30 ml of dichloromethane was added at one time while being stirred strongly. It was continued to stir the mixture at a room temperature (up to 20° C.) for 2 hours.

After completion of the reaction, an aliquot of the organic phase was obtained, rinsed with water, and poured into 400 ml of methanol. The resultant precipitation was filtered, washed with methanol and water and dried under a reduced pressure to obtain 2.70 g of yellow brown solid (yields: corresponding to 97%).

Infrared Absorption Spectrum: 2940, 2868, 1776, 1684 $cm^{-1}$

Example of Synthesis 3 (Synthesis of [Compound (23)])

2.40 g (10 mmol) of 1,4-dihydroxyanthraquinone and 0.84 g (21 mmol) of sodium hydroxide were dissolved into 40 ml of water, to which 50 mg of tetra(n-butyl)ammonium iodide was added. Then, a solution obtained by dissolving 4.30 g (10 mmol) of 2,2-diphenyl-1,1,1,3,3,3-hexafluoropropane-4',4"-dicarbonyl chloride into 30 ml of dichloromethane was added at one time while being stirred strongly. It was continued to stir the mixture at a room temperature for 2 hours.

After completion of the reaction, an aliquot of the organic phase was obtained, rinsed with water, and poured into 500 ml of methanol. The resultant precipitation was filtered, washed with methanol and water and dried under a reduced pressure to obtain 5.66 g of yellow brown solid (yields: corresponding to 95%).

Infrared Absorption Spectrum: 1752, 1682, 1592 $cm^{-1}$

Example of Synthesis 4 (Synthesis of [Compound (32)])

2.14 g (10 mmol) of 4,4'-dihydroxybenzophenone, 0.82 g (20 mmol) of sodium hydroxide, and 50 mg of tetra(n-butyl) ammonium iodide were dissolved into 30 ml of water. Then, a solution obtained by dissolving 2.40 g (10 mmol) of sebacoyl chloride into 50 ml of dichloromethane was added, which was continued to stir at a room temperature for 3 hours. After completion of the reaction, the mixture was diluted with 50 ml of methanol and 100 ml of water. An aliquot of the organic phase was obtained, rinsed with water, and poured into 200 ml of dichloromethane. The resultant precipitation was filtered, washed with methanol, water, and acetone and dried under a reduced pressure to obtain 5.66 g of white solid (yields: 79%).

Infrared Absorption Spectrum: 2932, 2856, 1760, 1652, 1602 $cm^{-1}$

Example 1

1.50 g of compound (1) obtained in the Example of Synthesis (1) was dissolved into 30 ml of m-cresol, which was applied by dipping to an aluminum pipe (40 mmϕ×318 mm). The applied solution was dried at 150° C. for 30 minutes to form an undercoat layer of 1.0 μm thick.

A dispersion obtained by dispersing 1 part by weight of X-type metal-free phthalocyanine, 1 part by weight of vinyl chloride/vinyl acetate copolymer (VMCH, produced by Union Carbide Co.), and 40 parts by weight of n-butyl acetate by means of a sand mill with glass beads of 1 mmϕ for 2 hours. The dispersion was applied by dipping to the above-mentioned undercoat layer and dried at 100° C. for 10 minutes to obtain a charge generating layer of 0.2 μm thick.

Finally, a solution obtained by dissolving 1 part by weight of N,N'-diphenyl-N,N'-bis(3-methylphenyl)benzidine and 1 part by weight of poly(4,4-cyclohexylidene diphenylene carbonate) resin into 6 parts by weight of monochlorobenzene was applied by dipping to the above-mentioned charge generating layer and dried at 135° C. for 1 hour to form a charge transfer layer of 0.2 μm thick. A photosensitive body for electrophotography for a test was thus produced.

Evaluation tests on electrical properties were conducted on the photosensitive body for electrophotography by using an evaluation machine that is a convert of a laser printer (XP-11; manufactured by Fuji Xerox Co., Ltd.). The evaluation on the electrical properties were carried out by measuring an electric potential ($V_H$) across the surface of the charged photosensitive body without irradiation of a laser beam, an electric potential ($V_L$) across the surface thereof exposed to a laser beam of 12 erg/cm$^2$, and an electric potential ($V_R$) across the surface thereof exposed to a laser beam of 30 erg/cm$^2$.

The above measurement was repeated for 1,000 times for each photosensitive body at an ordinary temperature and ordinary humidity (20° C., 40% RH) and at a low temperature and low humidity (10° C., 20% RH). Initial electric potential was compared with that after 1,000 times repeated test, whereby the stability in repeated service was evaluated.

The results are shown in Table 8 below.

Example 2

Example 1 was repeated except that the compound (7) obtained in the Example of Synthesis (2) was used as the component of the undercoat layer to produce a photosensitive body for electrophotography. Evaluation tests were carried out on the electrical properties in the same manner as in Example 1.

The results are shown in Table 8 below.

Example 3

Example 1 was repeated except that the compound (23) obtained in the Example of Synthesis (3) was used as the component of the undercoat layer and that 1,1,2,2,-tetrachloroethane was used as a coating solvent to produce a photosensitive body for electrophotography. Evaluation tests were carried out on the electrical properties thereof properties in the same manner as in Example 1. The results are shown in Table 8 below.

Example 4

1.5 g of compound (32) obtained in the Example of Synthesis (4) was dissolved into 40 ml of 1,1,2,2-tetrachloroethane, along with 0.75 g of 3-methacryloxypropyl trimethoxysilane. The resultant solution was applied by dipping to an aluminum pipe (40 mmϕ×318 mm). The applied solution was dried at 150° C. for 30 minutes to form an undercoat layer of 1.0 μm thick. A charge generating layer and a charge transfer layer were formed in the same manner as in Example 1 to produce a photosensitive body for electrophotography. Evaluation tests were carried out on the electrical properties thereof properties in the same manner as in Example 1. The results are shown in Table 8.

Example 5

Example 1 was repeated to produce a photosensitive body for electrophotography except that the compound (1) obtained in the Example of Synthesis (1) was used as the component of the undercoat layer and that dichloro tin phthalocyanine crystals prepared in a manner described in JP-A No. 3-274872 was used as the component of the charge generating layer in place of the X-type metal-free phthalocyanine. Evaluation tests were carried out on the electrical properties thereof properties in the same manner as in Example 1. The results are shown in Table 8.

Example 6

1.5 g of compound (1) obtained in the Example of Synthesis (1) and 0.1 g of 9-dicyanomethylenefluolene-4-n-octyl carboxylate that is an electron acceptor compound were dissolved into 30 ml of m-cresol. The resultant solution was applied by dipping to an aluminum pipe (40 mmϕ×318 mm). The applied solution was dried at 150° C. for 30 minutes to form an undercoat layer of 3.0 μm thick. A charge generating layer and a charge transfer layer were formed in the same manner as in Example 1 to produce a photosensitive body for electrophotography. Evaluation tests were carried out on the electrical properties thereof properties in the same manner as in Example 1. The results are shown in Table 8.

Example 7

1.5 g of compound (23) obtained in the Example of Synthesis (3) and 0.06 g of an electron acceptor compound, N,N-bis(3,4-dimethylphenyl)biphenyl-4-amine were dissolved as the components of the undercoat layer into 30 ml of 1,1,2,2-tetrachloroethane. The solution was applied by dipping to an aluminum pipe (40 mmϕ×318 mm). The applied solution was dried at 150° C. for 30 minutes to form an undercoat layer of 1.0 μm thick. The photosensitive body for electrophotography was produced in the same manner as in Example 1. Evaluation tests were carried out on the electrical properties thereof properties in the same manner as in Example 1. The results are shown in Table 8.

Example 8

1.5 g of compound (23)obtained in the Example of Synthesis (3) and 0.03 g of an organic metal complex salt, zirconium acetyl atonate were dissolved as the components of the undercoat layer into 30 ml of 1,1,2,2-tetrachloroethane. The solution was applied by dipping to an aluminum pipe (40 mmϕ×318 mm). The applied solution was dried at 150° C. for 30 minutes to form an undercoat layer of 1.0 μm thick. The photosensitive body for electrophotography was produced in the same manner as in Example 1. Evaluation tests were carried out on the electrical properties thereof properties in the same manner as in Example 1. The results are shown in Table 8.

Example 9

1.5 g of compound (32) obtained in the Example of Synthesis (4) and 0.15 g of 2,5-diethyl-7,7,8,8,-tetracyanoquinodimethane as an electron acceptor compound were dissolved as the components of the undercoat layer into 30 ml of 1,1,2,2-tetrachloroethane. The resultant solution was applied by dipping to an aluminum pipe (40 mmϕ×318 mm). The applied solution was dried at 150° C. for 30 minutes to form an undercoat layer of 2.0 μm thick. Subsequently, a photosensitive body for electrophotography was produced in the same manner as in Example 1. Evaluation tests were carried out on the electrical properties thereof properties in the same manner as in Example 1. The results are shown in Table 8.

Comparative Example 1

A solution obtained by dissolving 1.5 parts by weight of polyester resin (Pyron 200 produced by Toyo Trading Co., Ltd.) and 0.5 parts by weight of 2,4,7-trinitrofluorene into 20 parts by weight of 1,1,2,2-tetrachloroethane was applied by dipping to an aluminum pipe and dried at 150° C. for 10 minutes to form an undercoat layer of 1.0 μm thick. A photosensitive body for electrophotography was produced in the same manner as in Example 1. Evaluation tests were carried out on the electrical properties thereof properties in the same manner as in Example 1. The results are shown in Table 8.

Comparative Example 2

A solution obtained by dissolving 1 part by weight of copolymer nylon resin (Aramine CM8000 produced by Toray Co.) into 8 parts by weight of ethanol was applied by dipping to an aluminum pipe and dried at 150° C. for 10 minutes to form an undercoat layer of 1.0 μm thick. A photosensitive body for electrophotography was produced in the same manner as in Example 1. Evaluation tests were carried out on the electrical properties thereof properties in the same manner as in Example 1. The results are shown in Table 8.

| | | 20° C., 40% RH | | | 10° C., 20% RH | | |
|---|---|---|---|---|---|---|---|
| | | $V_{H(V)}$ | $V_{L(V)}$ | $V_{R(V)}$ | $V_{H(V)}$ | $V_{L(V)}$ | $V_{R(V)}$ |
| Ex 1 | Initial | −790 | −100 | −30 | −800 | −110 | −35 |
| | After 1000 times | −800 | −110 | −40 | −815 | −120 | −45 |
| Ex 2 | Initial | −800 | −110 | −40 | −805 | −120 | −45 |
| | After 1000 times | −820 | −125 | −60 | −830 | −140 | −60 |
| Ex 3 | Initial | −805 | −100 | −35 | −810 | −110 | −40 |
| | After 1000 times | −820 | −115 | −50 | −830 | −130 | −55 |
| Ex 4 | Initial | −805 | −110 | −40 | −810 | −110 | −50 |
| | After 1000 times | −825 | −130 | −60 | −835 | −135 | −70 |
| Ex 5 | Initial | −795 | −80 | −30 | −800 | −90 | −40 |
| | After 1000 times | −810 | −90 | −45 | −820 | −100 | −55 |
| Ex 6 | Initial | −810 | −110 | −40 | −820 | −120 | −50 |
| | After 1000 times | −815 | −120 | −50 | −825 | −130 | −60 |
| Ex 7 | Initial | −780 | −95 | −30 | −790 | −100 | −35 |
| | After 1000 times | −800 | −110 | −45 | −815 | −120 | −50 |
| Ex 8 | Initial | −810 | −105 | −35 | −815 | −120 | −50 |
| | After 1000 times | −825 | −115 | −45 | −830 | −135 | −65 |
| Ex 9 | Initial | −785 | −100 | −35 | −800 | −110 | −45 |
| | After 1000 times | −800 | −110 | −50 | −810 | −125 | −60 |
| Com Ex 1 | Initial | −800 | −150 | −90 | −830 | −300 | −250 |
| | After 1000 times | −840 | −180 | −130 | −880 | −380 | −340 |
| Com Ex 2 | Initial | −800 | −90 | −30 | −805 | −150 | −75 |
| | After 1000 times | −830 | −120 | −70 | −850 | −210 | −120 |

Ex: Example
Com Ex: Comparative Example

As apparent from Table 8, the photosensitive bodies for electrophotography according to the present invention had good charging characteristics, and a low residual electric potential at a low temperature and low humidity, and were less fluctuated in electric potential after being used repeatedly, both for the Examples 1 through 5 in which the undercoat layer formed of the polyester compound represented by the aforementioned general formula (I) was provided and the Examples 6 through 9 in which the organic low molecule material was further dispersed.

On the other hand, it was revealed that the Comparative Examples 1 and 2 in which the undercoat layer formed of a known polymer compound was provided exhibited significant fluctuation in electric potential after being used repeatedly, in particular, at a low temperature and low humidity, which was far from a stable property.

What is claimed is:

1. A photosensitive body for electrophotography comprising a photoconductive layer formed on a conductive support through an undercoat layer, the undercoat layer containing at least one polyester compound having repeated units represented by the following general formula (I):

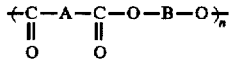

(I)

wherein A and B each independently represents a divalent aliphatic hydrocarbon or aromatic hydrocarbon which is optionally substituted, at least one of A and B being selected from the group consisting of divalent groups represented by the following general formulae (II)–(VI), and n is 10–10,000:

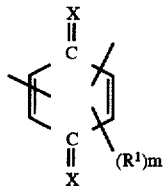

(II)

wherein $R^1$ represents an alkyl group, an aryl group, a halogen atom, a nitro group, an acyl group, or an amino group, X represents an oxygen atom or a group represented by the formula (II-1),

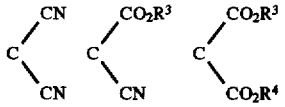

(II-1)

wherein $R^3$ and $R^4$ each independently represents an alkyl group or an aryl group, and m represents an integer of 0–2,

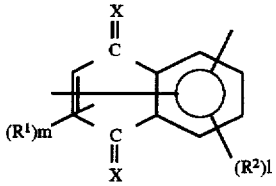

(III)

wherein $R^1$, $R^3$, $R^4$, X and m are same as those defined above, $R^2$ is selected independently of $R^1$ and represents an alkyl group, an aryl group, a halogen atom, a nitro atom, an acyl group, or an amino group, and 1 is selected independently of m and represents an integer of 0–2,

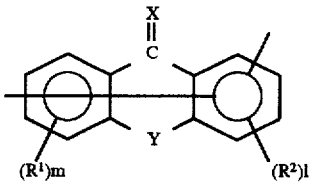

(IV)

wherein $R^1$, $R^2$, X, m, and l are same as those represented by the aforementioned general formula (III), Y represents C=X (X is same as the one defined above), O, S, $SO_2$, or $NR^5$, wherein $R^5$ represents a hydrogen atom, an alkyl group, an aryl group, or an acyl group,

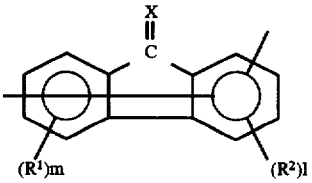

(V)

wherein $R^1$, $R^2$, X, m, and l are same as those represented by the aforementioned general formula (III), and

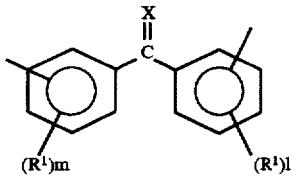

(VI)

wherein $R^1$, $R^2$, X, m, and l are same as those represented by the aforementioned general formula (III).

2. A photosensitive body for electrophotography as claimed in claim 1, wherein an organic low molecule compound is dispersed in the undercoat layer.

3. A photosensitive body for electrophotography as claimed in claim 1, wherein the polyester compound is a copolymer polyester containing other repeated units.

4. A photosensitive body for electrophotography as claimed in claim 2, wherein the polyester compound is a copolymer polyester containing other repeated units.

5. A photosensitive body for electrophotography as claimed in claim 2, wherein the organic low molecule compound is an electron acceptor compound.

6. A photosensitive body for electrophotography as claimed in claim 2, wherein the organic low molecule compound is an electron donor compound.

7. A photosensitive body for electrophotography as claimed in claim 2, wherein the organic low molecule compound is an organic metal complex salt.

8. A photosensitive body for electrophotography as claimed in claim 1, wherein the photoconductive layer contains a phthalocyanine pigment as a charge generating substance.

9. A photosensitive body for electrophotography as claimed in claim 2, wherein the photoconductive layer contains a phthalocyanine pigment as a charge generating substance.

10. A photosensitive body for electrophotography as claimed in claim 1, wherein n is from 50 to 1,000.

11. A photosensitive body for electrophotography comprising a photoconductive layer formed on a conductive support through an undercoat layer, the undercoat layer containing at least one polyester compound having repeated units represented by the following general formula (I'):

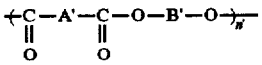

(I')

wherein A' and B' each independently represents a divalent aliphatic hydrocarbon or aromatic hydrocarbon which is optionally substituted, at least one of A' and B' being selected from the group consisting of divalent groups represented by the following general formulae (II')–(VI'), and n is 10–10,000:

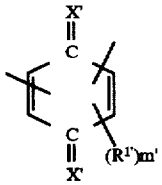

(II')

wherein $R^{1'}$ represents an alkyl group having from 1 to 4 carbon atoms, an aryl group having from 6 to 10 carbon atoms, a halogen atom, a nitro group, an acyl group, or an amino group, X' represents an oxygen atom or a group represented by the formula (II-1'),

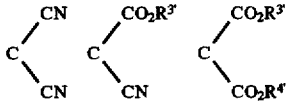

wherein $R^{3'}$ and $R^{4'}$ each independently represents an alkyl group having from 1 to 10 carbon atoms or an aryl group having from 6 to 10 carbon atoms, and m' represents an integer of 0–2:

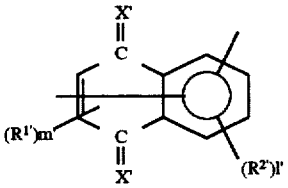

(III')

wherein $R^{1'}$, $R^{3'}$, $R^{4'}$, X' and m' are same as those defined above, $R^{2'}$ is independent of $R^{1'}$ and represents an alkyl group having from 1 to 4 carbon atoms, an aryl group having from 6 to 10 carbon atoms, a halogen atom, a nitro atom, an acyl group, or an amino group, and 1' is selected independently of m' and represents an integer of 0–2,

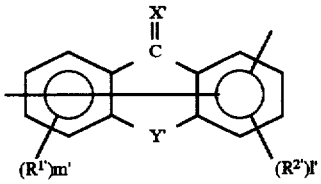

(IV')

wherein $R^{1'}$, $R^{2'}$, X', m' and 1' are same as those represented by the aforementioned general formula (III'), Y' represents C=X' (X' is same as the one defined above), O, S, $SO_2$, or $NR^{5'}$, $R^{5'}$ represents a hydrogen atom, an alkyl group having from 1 to 10 carbon atoms, an aryl group having from 6 to 10 carbon atoms, or an acyl group,

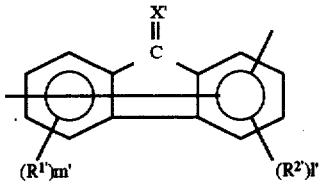

(V')

wherein $R^{1'}$, $R^{2'}$, X', m' and 1' are same as those represented by the aforementioned general formula (III'), and

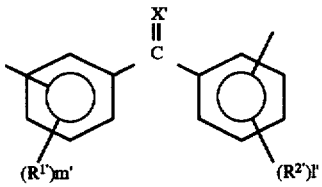

(VI')

wherein $R^{1'}$, $R^{2'}$, X', m' and 1' are same as those represented by the aforementioned general formula (III').

12. A photosensitive body for electrophotography as claimed in claim 11, wherein an organic low molecule compound is dispersed in the undercoat layer.

13. A photosensitive body for electrophotography as claimed in claim 11, wherein the polyester compound is a copolymer polyester containing other repeated units.

14. A photosensitive body for electrophotography as claimed in claim 12, wherein the polyester compound is a copolymer polyester containing other repeated units.

15. A photosensitive body for electrophotography as claimed in claim 11, wherein the organic low molecule compound is an electron acceptor compound.

16. A photosensitive body for electrophotography as claimed in claim 11, wherein the organic low molecule compound is an electron donor compound.

17. A photosensitive body for electrophotography as claimed in claim 11, wherein the organic low molecule compound is an organic metal complex salt.

18. A photosensitive body for electrophotography as claimed in claim 11, wherein the photoconductive layer contains a phthalocyanine pigment as a charge generating substance.

19. A photosensitive body for electrophotography as claimed in claim 12, wherein the photoconductive layer contains a phthalocyanine pigment as a charge generating substance.

20. A photosensitive body for electrophotography as claimed in claim 11, wherein n is from 50 to 1,000.

* * * * *